US006782799B2

(12) United States Patent
Vincent

(10) Patent No.: US 6,782,799 B2
(45) Date of Patent: Aug. 31, 2004

(54) DOUBLE ACTING HYDRAULIC CYLINDER WITH AXIAL LOCKING DEVICE

(75) Inventor: Pierre Vincent, Saint Hilaire du Loulay (FR)

(73) Assignee: Hydraulique Production Systems, Ennery (FR)

( * ) Notice: Subject to any disclaimer, the term of this patent is extended or adjusted under 35 U.S.C. 154(b) by 76 days.

(21) Appl. No.: 10/311,285

(22) PCT Filed: Jun. 27, 2001

(86) PCT No.: PCT/FR01/02030

§ 371 (c)(1),
(2), (4) Date: Dec. 17, 2002

(87) PCT Pub. No.: WO02/01079

PCT Pub. Date: Jan. 3, 2002

(65) Prior Publication Data

US 2003/0140778 A1 Jul. 31, 2003

(30) Foreign Application Priority Data

Jun. 27, 2000 (FR) ..... 00 08226

(51) Int. Cl.[7] ..... F15B 15/26
(52) U.S. Cl. ..... 92/24; 91/43; 91/44; 92/23
(58) Field of Search ..... 91/43, 44; 92/23, 92/24

(56) References Cited

U.S. PATENT DOCUMENTS 3,350,987 A * 11/1967 Johnson ..... 92/24
3,941,141 A * 3/1976 Robert ..... 92/24
4,305,565 A * 12/1981 Abbe ..... 92/24
5,056,418 A 10/1991 Granger et al.
5,575,452 A * 11/1996 Whitby et al. ..... 92/28

FOREIGN PATENT DOCUMENTS

| | | |
|---|---|---|
| DE | 1 257 583 | 12/1967 |
| FR | 2 540 194 | 8/1984 |
| GB | 2 184 784 A | 7/1987 |

* cited by examiner

*Primary Examiner*—Edward K. Look
*Assistant Examiner*—Igor Kershteyn
(74) *Attorney, Agent, or Firm*—Nath & Associates PLLC; Marvin C. Berkowitz

(57) ABSTRACT

A double-acting hydraulic actuator with an axial locking device has a cylinder chamber defined by two coaxial cylindrical walls of different diameters interconnected by a frustoconical wall. A guide piston sliding in the smaller-diameter cylindrical wall is fixed to an end of an actuator rod. The actuator rod has an annular protuberance of diameter equal to the diameter of the cylindrical wall. An annular stepped piston providing sealing between the two cylinder chambers is slidably mounted in a middle portion of the actuator rod to slide between the piston and the annular protuberance. When the actuator is extended, a narrowed end of the annular piston bears against conical surfaces of two half-rings and urges them outwards. When the half-rings are pushed outwards and the narrowed end of the annular piston becomes interposed between them and the middle portion of the actuator rod.

5 Claims, 4 Drawing Sheets

DOUBLE ACTING HYDRAULIC CYLINDER WITH AXIAL LOCKING DEVICE

The invention relates to a double-acting hydraulic actuator comprising a cylinder body closed at one end by an end wall and at the other end by a cylinder head, a guide piston slidably mounted in the cylinder body, an actuator rod secured to the guide piston and passing in leaktight manner through the cylinder head, hydraulic means for actuating the actuator rod, and mechanical locking means for locking the actuator rod in a predetermined extended position.

In numerous applications, actuators are used for moving parts or tools, and said parts or tools need to be held in a fixed position throughout the duration of an operation.

This applies in particular when the parts in question are elements of a multi-part mold used for injection-molding pieces out of plastics material. In general, each mold element is fixed to the end of an actuator rod and actuating the actuator rod causes the element to move in translation. To prevent the actuator rod from retracting while the plastics material is being injected under high pressure, the moving element is prevented from moving relative to a fixed structure by means of a pin received in a bore formed in the element and in the structure, the bore extending in a direction perpendicular to the axis of the actuator rod. The pin is also handled by a second double-acting actuator. Thus, in order to position and fix a mold element relative to the structure, two double-acting actuators are used having rods that form a right angle, one of the actuators serving to displace the mold element while the other actuator serves to displace the fixing pin. The stresses due to pressure forces during molding are then taken up by the fixing pin.

That technique thus requires a bore to be made in each mold element and it requires two double-acting actuators to be available for each mold element. Above all, it presents the drawback of requiring considerable time both to put the mold into place and to perform unmolding, since the two actuators must be actuated consecutively. When the mold is being put into place, the actuator rod connected to the element is actuated first, and then once the element is in position, the actuator rod connected to the pin is actuated. For unmolding the injected part, the reverse procedure is performed.

DE 12 57 583 discloses a hydropneumatic actuator in which:

a) the cylinder body presents two coaxial cylindrical walls of different inside diameters and interconnected by a frustoconical annular section, the larger-diameter cylindrical wall being placed beside the cylinder head and the smaller-diameter cylindrical wall serving to guide the guide piston;

b) the actuator rod presents an annular protuberance between the guide piston and the cylinder head, the diameter of the protuberance being not more than the diameter of the smaller-diameter cylindrical wall, said protuberance being disposed in register with the larger-diameter cylindrical wall when the actuator rod is in the predetermined extended position;

c) the guide piston has means putting both sides of said guide piston into fluid communication;

d) an annular piston is placed on the portion of the actuator rod that is situated between the guide piston and the annular protuberance, the annular piston being capable of sliding in leaktight manner against the smaller-diameter cylindrical wall and being capable of sliding in leaktight manner against said portion of the actuator rod under drive of pressure agent between a position in which the actuator rod is released in which it bears against the guide piston, and a locked position in which it bears against the annular protuberance, said annular piston presenting a narrowed end section adjacent to the annular protuberance; and e) the locking means have locking members and means for urging said locking members to move radially, which locking members, in the released position of the actuator rod, are received axially between a radial face of the protuberance and the annular piston and are housed radially between the portion of the actuator rod and the smaller-diameter cylindrical wall, and in the locked position, are received radially between the larger-diameter cylindrical wall and the narrowed end section of the annular piston and are housed axially between said radial face of the protuberance and the frustoconical section of the cylinder body.

In that document, the narrowed end of the annular piston is frustoconical and it terminates in a plane front face. The means for moving the locking members radially comprise chamfered pins passing axially through the annular protuberance and having chamfers disposed between the locking members to move them apart when the pins come to press against the head of the cylinder in the maximally extended position of the actuator rod. In the locked position, locking members bear against the frustoconical annular section of the cylinder body and against the frustoconical narrowed end of the annular piston. That is why that document provides for a spring between the annular piston and the guide piston.

The spring needs to exert considerable force in order to prevent total or partial unlocking of the actuator while the actuator rod is withstanding forces during an injection-molding operation. In addition, the chamfered pins are of a given length, which prevents subsequent modification of the length of the larger-diameter cylindrical wall in order to adjust the extended position of the actuator rod during injection-molding. In addition, the pressure of the fluid must be sufficient to compensate for the forces delivered by the spring.

An object of the invention is to propose a double-acting actuator which makes it possible to position a mold element in an accurate position and to withstand external compression forces exerted on the actuator rod during a molding operation, e.g. an injection-molding operation.

Another object of the invention is to provide a double-acting actuator in which the piston rod can be held stationary mechanically and with precision in a predetermined extended position.

Starting from the above state of the art, the hydraulic actuator of the present invention is characterized by the fact that the narrowed end section of the annular piston is cylindrical and is terminated by a conical surface for co-operating with a conical surface of the locking members so as to urge them radially outwards when the pressure agent acts on said annular piston in the direction for extending the actuator rod.

Thus, in the locked position, when the actuator rod is withstanding forces tending to cause it to retract, the locking members bear against the frustoconical annular section of the actuator body and exert radial forces only on the cylindrical narrowed section of the annular piston. The prior art spring is thus unnecessary and small pressures suffice for moving the actuator rod. The chamfered pins of the prior art are also eliminated.

Because the locking members in the locked position are spaced apart outwards and co-operate with the frustoconical section of the cylinder body, the bearing surfaces may be large in area, and the compression forces exerted axially on the head of the actuator rod can be taken up by the locking members alone, without any help from the pressure agent.

In order to increase considerably the area of the bearing surfaces, the locking members have conical surfaces facing radially outwards, which surfaces, in the locked position, co-operate with the frustoconical section of the cylinder body.

Preferably, the locking members are constituted by two half-rings.

In order to facilitate maintenance of the actuator in the event of the actuator rod buckling, the actuator rod is made up of two separable cylindrical parts connected together by screw-fastening, one of the parts having the annular protuberance and the portion of the piston rod on which the annular piston is mounted, and the other part sliding in the cylinder head.

Thus, in the event of the actuator rod buckling, the integrity of the internal portion of the actuator is ensured, and it suffices to use a spare part to replace the portion which slides in the cylinder head.

In order to enable the locked position to be adjusted accurately, the cylinder body is constituted by two coaxial portions, of which an outer portion includes the cylinder head, means for fixing to a structure, couplings for coupling to a fluid source, and a cylindrical outer wall having inside tapping, and an inner other portion comprises the end wall of the cylinder body and the body of the cylinder chamber, and presents an outside thread for co-operating with said inside tapping so as to enable the predetermined extended position to be adjusted relative to the structure, internal ducts being provided in said two portions between the couplings and the ends of the cylinder chamber.

This disposition presents an additional advantage. Because the couplings are disposed on the external portion fixed to the structure, the external ducts for hydraulic fluid delivery and exhaust are not subjected to any modification during adjustment. They can be constituted by rigid metal ducts instead of using flexible hoses.

Other advantages and characteristics of the invention appear on reading the following description given by way of example and with reference to the accompanying drawings, in which.

Figure 1:
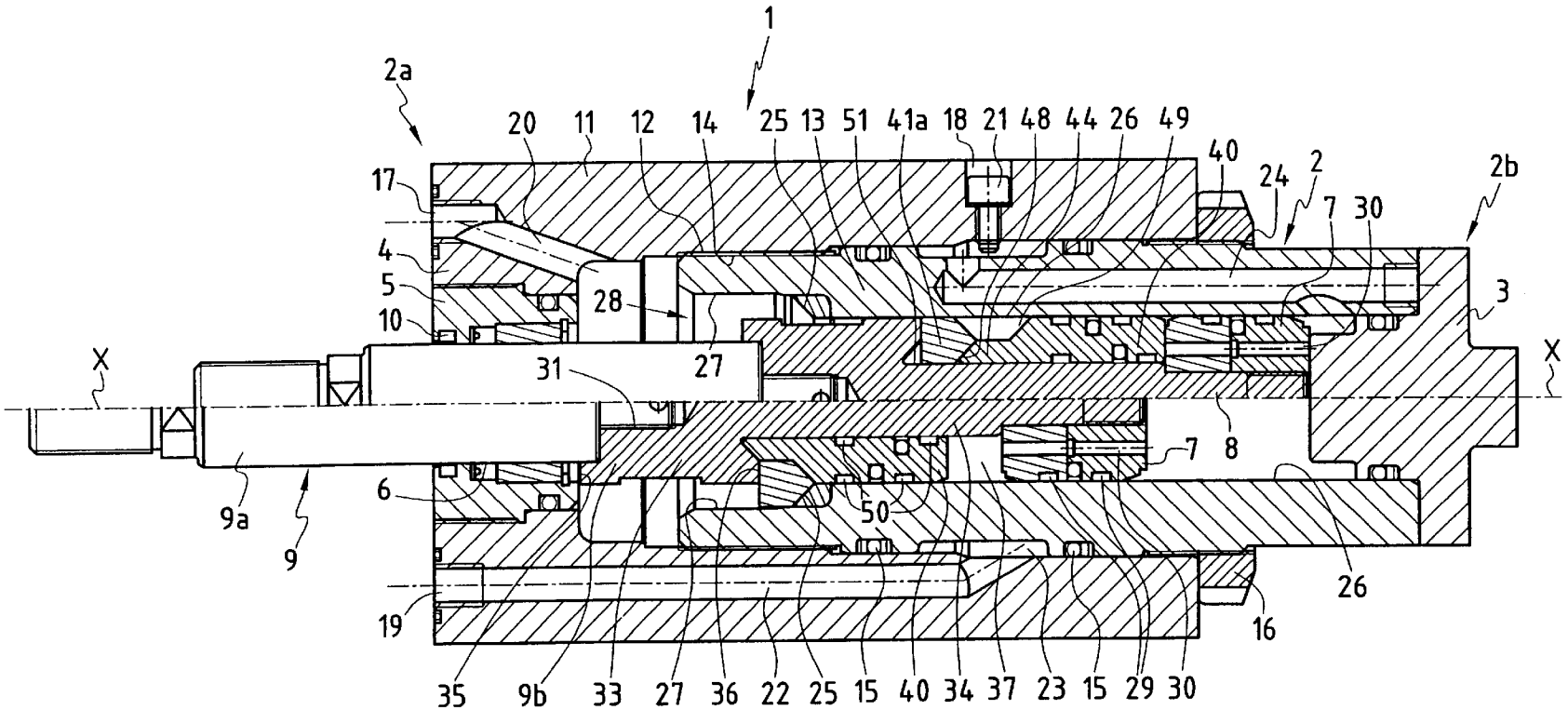
FIG. 1 is a section view on a plane containing the axis of the cylinder of an actuator in accordance with the invention, the top portion of this figure is a half-section of the actuator rod in its maximally retracted and unlocked position, while the bottom portion of the figure shows the actuator rod in half-section in its locked position.

In the drawings, reference 1 designates a double-acting hydraulic actuator comprising a cylinder body 2 closed at one end by an end wall 3 and at its other end by a cylinder head 4 presenting a bearing 5 with an orifice 6 on an axis X.

A piston 7 is fixed to the inside end 8 of an actuator rod 9 passing through the orifice 6 with interposed sealing gaskets 10.

As shown in FIG. 1, the cylinder body 2 is constituted by two coaxial portions 2*a*, 2*b* about the axis X which are nested one in the other. The outer portion 2*a* is in the form of a rigid vessel whose cylindrical peripheral wall 11 presents inside tapping 12 and whose end wall is fitted with the bearing 5. The inner portion 2*b* is in the form of an oppositely-directed vessel whose peripheral wall 13 presents an outside thread 14 and whose end wall forms the end wall 3 of the cylinder body 2. The tapping 12 and the thread 14 are of identical diameter so as co-operate in order to fix the inner portion 2*b* axially inside the outer portion 2*a*. Sealing gaskets 15 are interposed between the outer portion 2*a* and the inner portion 2*b*. A nut 16 and a screw 21 placed in a bore 18 serve to prevent the inner portion 2*b* from turning relative to the outer portion 2*a*. The cylindrical peripheral wall 11 of the outer portion 2*a* is fitted with couplings 17 and 19 for connecting pressure agent delivery and exhaust ducts, said agent preferably being oil. The coupling 17 communicates with the end of the inside cavity of the cylindrical body 2 that is situated close to the bearing 5 via a duct 20 formed in the cylindrical peripheral wall 11. The coupling 19 communicates via a duct 22 formed in the cylindrical peripheral wall 11 with an annular chamber 23 formed between the outer and inner portions 2*a* and 2*b* in the cylindrical peripheral wall 11 of the peripheral wall 13. A duct 24 provided in the peripheral wall 13 of the inner portion 2*b* puts the annular chamber 23 into communication with the end of the inside cavity of the cylinder body 2 situated beside the end wall 3. The outer portion 2*a* is also provided with means for fixing to an external structure, these fixing means being omitted from the drawings for reasons of clarity. The inner portion 2*b* can thus be positioned in an axially-adjustable manner within the fixed outer portion 2*a*. The couplings 17 and 19 are thus stationary relative to the structure which also supports the source of pressure agent.

As can be seen in the drawings, the inside cavity of the inner portion 2*b* is defined by two cylindrical walls about the axis X, which walls are of different diameters, being interconnected by a frustoconical wall 25 about the axis X, the smaller-diameter cylindrical wall 26 being disposed adjacent to the end wall 3, while the larger-diameter cylindrical wall 27 is disposed adjacent to the opening 28 of the inner portion 2*b*, i.e. beside the cylinder head 4.

The piston 7 is mounted to slide in the smaller-diameter cylindrical wall 26, possibly with a sealing gasket 29 being disposed between them. It also has through orifices 30 on the axis X which put the two faces of the piston 7 into fluid communication with each other.

The actuator rod 9 is likewise made up of two portions, namely an outer portion 9*a* which slides in the bearing 5, and an inner portion 9*b*, both of which portions share the axis X. The outer portion 9*a* is terminated inside the cylindrical body 2 by a thread 31 which co-operates with tapping formed at the end of the inner portion 9*b* remote from the piston 7.

The inner portion 9*b* has three sections of different diameters, namely a section 33 of diameter no greater than the smaller-diameter cylindrical wall 26, situated around the above-mentioned tapping; a middle section 34 of diameter equal to about half the diameter of the cylindrical wall 26; and a narrowed section constituting the end 8 on which the piston 7 is mounted.

The large-diameter section 33 is defined axially by two end walls 35 and 36 extending radially outwards. The end wall 35 in abutment against the cylinder head 4 defines the maximum possible extension for the actuator rod 9. The end wall 36 placed facing the piston 7 cooperates therewith to define axially an annular chamber 37 surrounding the middle section 34. When the actuator rod 9 is in its maximally retracted position, as is shown in the top half-section of FIG. 1, the large-diameter section 33 is disposed at least in part in the smaller-diameter cylindrical wall 26, and the annular chamber 37 is defined on the outside by the cylindrical wall 26.

Figure 3:
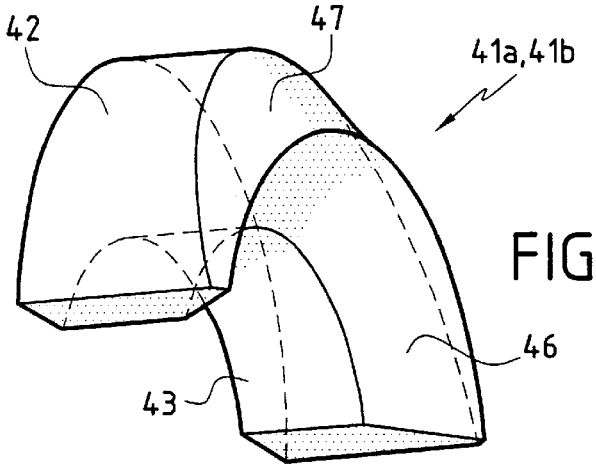
FIG. 3 is a perspective view of a locking half-ring.
Figure 4:
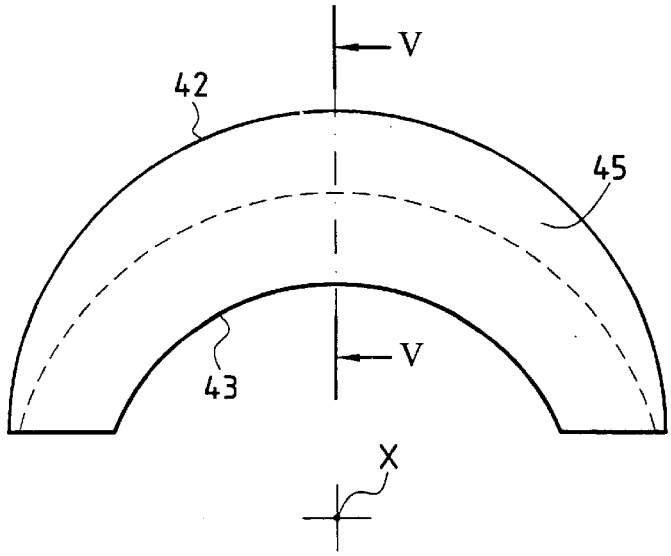
FIG. 4 is an axial view of a locking half-ring in the locked position.
Figure 5:
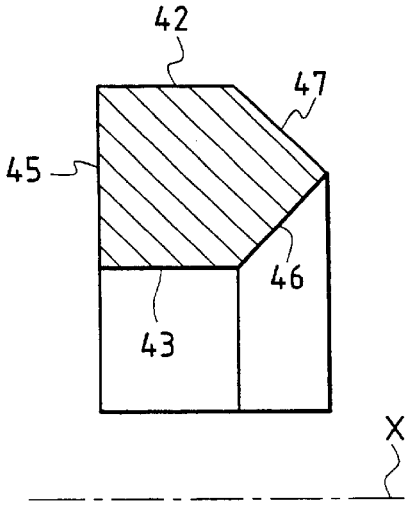
FIG. 5 is a section view of a half-ring on line V—V of FIG. 4.

This annular chamber 37 houses both a stepped annular piston 40 of inside diameter equal to the diameter of the middle section 34 and of outside diameter equal to the diameter of the smaller-diameter cylindrical wall 26, and two locking half-rings 41*a* and 41*b* which are shown in detail in FIGS. 3 to 5.

Each half-ring 41*a*, 41*b* is defined radially by an outer cylindrical wall portion 42 of diameter equal to the diameter of the cylindrical wall 26, an inner cylindrical wall portion 43 of diameter equal to the diameter of a cylindrical narrowed end portion 44 of the annular piston 40, and axially firstly by an end wall 45 bearing against the end wall 36 of the section 33, and secondly by two frustoconical walls 46 and 47 facing the piston 7.

In the unlocked position of the actuator rod 9, shown in the top half-section of FIG. 1, the outer cylindrical wall portion 42 bears slidably against the peripheral all 26, and the inner cylindrical wall portion 43 bears slidably against the middle section 34.

In this unlocked position, the annular piston 40 is interposed between the piston 7 and the half-rings 41*a*, 41*b*. The cylindrical narrowed end 44 of the annular piston is terminated by a conical surface 48 which cooperates with the frustoconical wall 46. The cylindrical narrowed end 44 of the annular piston 40 is connected to the outer cylindrical wall of said annular piston 40 via a second conical wall 49. The length of the cylindrical wall of the narrowed end 44 is substantially equal to the width of the inner cylindrical wall portions 43 of the half-rings 41*a* and 41*b*.

In addition, the outer diameter of the narrowed end 44 is substantially equal to half the sum of the diameters of the middle section 34 of the actuator rod 9 and of the cylindrical wall 26. In addition, the extent of the frustoconical wall 25 of the cylinder body 2 is substantially equal to the extent of the frustoconical walls 47 of the half-rings 41*a* and 41*b*.

Sealing gaskets 50 are interposed between the annular piston 40 and both the middle section 34 and the cylindrical wall 26.

FIGS. 2A to 2E show various positions taken by the actuator rod 9, the annular piston 40, and the half-rings 41*a*, 41*b* when a pressure agent is introduced into the cylinder body by the duct 24.

Figure 2A:
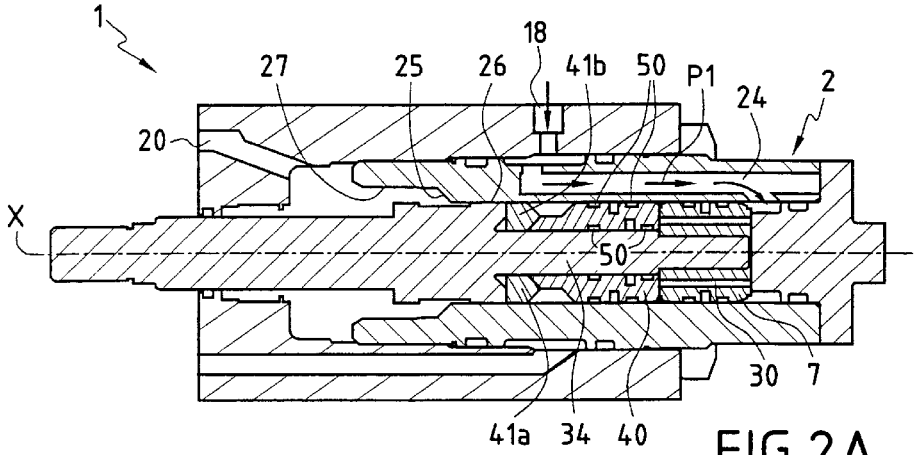
FIGS. 2A to 2E show various positions for the actuator rod in its cylinder while it is being deployed between its maximally retracted position and the locked position.
Figure 2B:
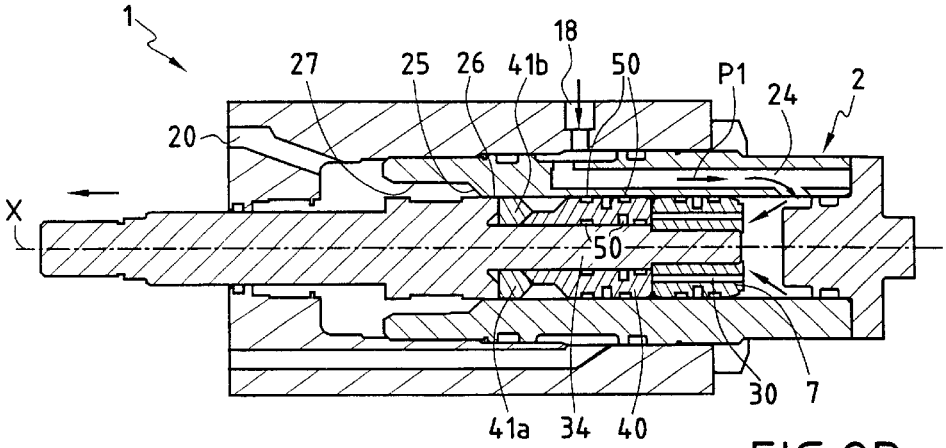

In FIG. 2A, the actuator rod 9 is in its maximally retracted position. The pressure agent is introduced via the coupling 19, the duct 22, the chamber 23, and the duct 24, with the duct 20 being connected to exhaust. The pressure P1 is applied against both faces of the piston 7. The half-rings 41*a* and 41*b* cannot move apart radially, the annular piston 40 remains stationary relative to the middle section 34. The actuator rod 9 is moved to the left, as shown in FIG. 2B.

Figure 2C:
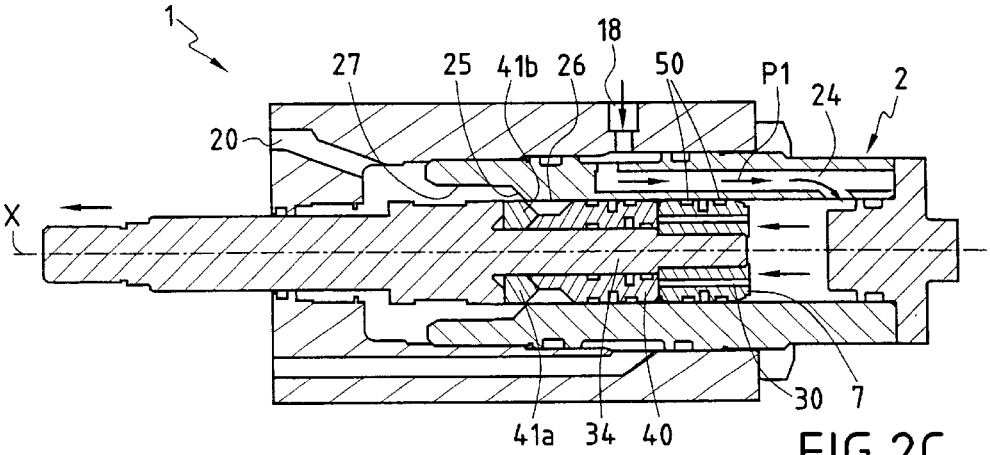
Figure 2D:
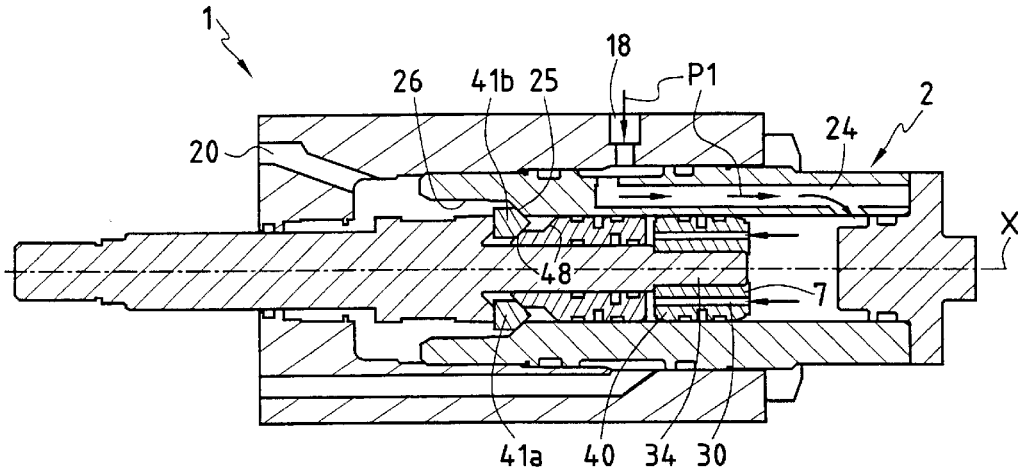

When the two half-rings 41*a* and 41*b* have gone past the cylindrical wall 26 and are positioned facing the frustoconical wall 25, as shown in FIG. 2C, the annular piston 40 subjected to the pressure P1 can slide along the middle section 34. Its frustoconical end wall 48 bearing against the frustoconical walls 46 of the half-rings urges them radially outwards, their frustoconical walls 47 then sliding along the frustoconical wall 25 of the cylinder body 2, as shown in FIG. 2D. When the half-rings 41*a* and 41*b* have moved apart as far as possible, the cylindrical narrowed portion 44 of the annular piston 40 slides along the inner cylindrical wall portions 43 of the half-rings 41*a* and 41*b*, and the frustoconical walls 46 of the half-rings bear against the frustoconical wall 49 of the annular piston 40. If the extension movement of the actuator rod 9 is continued, then the half-rings 41*a* and 41*b* slide along the larger-diameter cylindrical wall 27 until the end face 35 of the large-diameter section 33 comes into abutment against the cylinder head 4.

If the duct 24 is connected to exhaust and an axial force F is applied to the head of the actuator rod 9, then the assembly comprising the actuator rod 9, the half-rings 41*a* and 41*b*, and the annular piston 40 moves to the right until the frustoconical faces 46 and 47 of the half-rings 41*a* and 41*b* come to bear respectively against the frustoconical wall 48 of the annular piston 40 and against the frustoconical wall 25 of the cylinder body 2. The half-rings 41*a* and 41*b* are also prevented from moving radially between the cylindrical narrowed end portions 44 of the annular piston 40 and the larger-diameter cylindrical wall 27 of the cylindrical body 2, as can be seen in FIG. 2E.

Figure 2E:
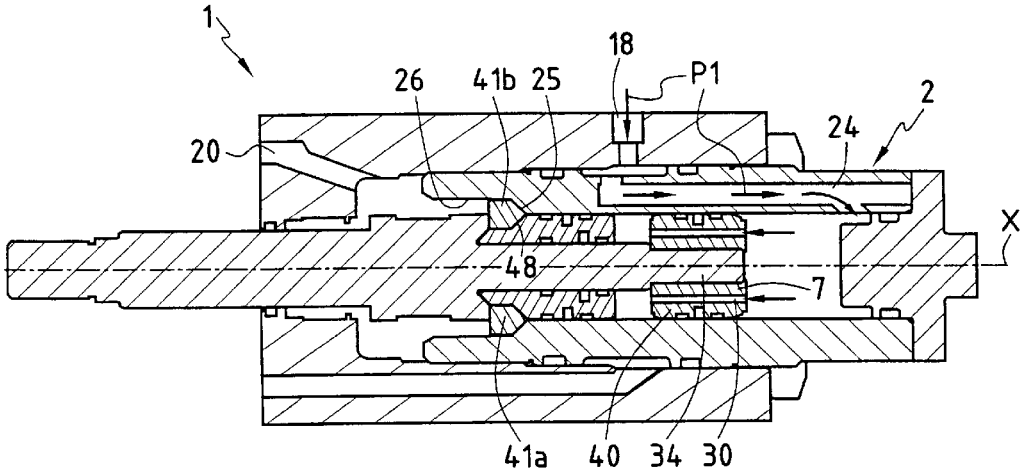

Starting from the position shown in FIG. 2E, if a pressure agent is introduced via the coupling 17, and the duct 20, this pressure agent will initially cause the annular piston 40 to move to the left, since the actuator rod 9 is locked in its extended position by the half-rings 41*a* and 41*b*. When the annular piston 40 reaches the position shown in FIG. 2D, the end face 36 pressing against the end faces 45 of the half-rings 41*a*, 41*b* tends to move these half-rings radially into the annular chamber 37. This process continues until the configuration shown in FIG. 2C is reached. From this position, the annular piston 40 bears against the piston 7 and the assembly moves to the right until the piston 7 is bearing against the end wall 3.

It should be observed that the piston 7 serves solely for guiding and centering the actuator rod 9 and for constituting an abutment for the annular piston 40. The gaskets 10 act solely as sliding means and they do not provide sealing.

The large-diameter section 33 of the inner portion 9*b* of the actuator rod 9 has a wedge-shaped annular cavity 51 in its end face 36 in which the narrowed end portion 44 of the annular piston is received when the two half-rings 41*a* and 41*b* are in the locking position.

What is claimed is:

1. A double-acting hydraulic actuator comprising a cylinder body (2) closed at one end by an end wall (3) and at the other end by a cylinder head (4), a guide piston (7) slidably mounted in the cylinder body (2), an actuator rod (9) secured to the guide piston (7) and passing in leaktight manner through the cylinder head (4), hydraulic means for actuating the actuator rod (9), and mechanical locking means for locking the actuator rod (9) in a predetermined extended position, in which:

a) the cylinder body (2) presents two coaxial cylindrical walls (26, 27) of different inside diameters and interconnected by a frustoconical annular section (25), the larger-diameter cylindrical wall (27) being placed beside the cylinder head (4) and the smaller-diameter cylindrical wall (26) serving to guide the guide piston (7);

b) the actuator rod (9) presents an annular protuberance (33) between the guide piston (7) and the cylinder head (4), the diameter of the protuberance being not more than the diameter of the smaller-diameter cylindrical wall (26), said protuberance (33) being disposed in register with the larger-diameter cylindrical wall (27) when the actuator rod (9) is in the predetermined extended position;

c) the guide piston (7) has means (30) putting both sides of said guide piston (7) into fluid communication;

d) an annular piston is placed on portion (34) of the actuator rod that is situated between the guide piston (7) and the annular protuberance (33), the annular piston (40) being capable of sliding in leaktight manner against the smaller-diameter cylindrical wall (26) and being capable of sliding in leaktight manner against said portion (34) of the actuator rod under drive of pressure agent between a position in which the actuator rod (9) is released in which it bears against the guide piston (7), and a locked position in which it bears against the annular protuberance (33), said annular piston (40) presenting a narrowed end section (44) adjacent to the annular protuberance (33); and e) the locking means have locking members (41*a*, 41*b*) and means for urging said locking members (41*a*, 41*b*) to move radially, which locking members, in the released position of the actuator rod (9), are received axially between a radial face (36) of the protuberance (33) and the annular piston (40) and are housed radially between the portion (34) of the actuator rod and the smaller-diameter cylindrical wall (26), and in the locked position, are received radially between the larger-diameter cylindrical wall (27) and the narrowed end section (44) of the annular piston (40) and are housed axially between said radial face (36) of the protuberance (33) and the frustoconical section (25) of the cylinder body (2);

the hydraulic actuator being characterized by the fact that the narrowed end section (44) of the annular piston (40) is cylindrical and is terminated by a conical surface (48) for co-operating with a conical surface (46) of the locking members (41*a*, 41*b*) so as to urge them radially outwards when the pressure agent acts on said annular piston (40) in the direction for extending the actuator rod (9).

2. An actuator according to claim 1, characterized by the fact that the locking members (41*a*, 41*b*) have conical surfaces (47) facing radially outwards, which surfaces, in the locked position, co-operate with the frustoconical section (25) of the cylinder body (2).

3. An actuator according to claim 2, characterized by the fact that the locking members are constituted by two half-rings (41*a*, 41*b*).

4. An actuator according to claim 1, characterized by the fact that the actuator rod (9) is made up of two separable cylindrical parts (9*a*, 9*b*) connected together by screw-fastening, one of the parts (9*b*) having the annular protuberance (33) and the portion (34) of the piston rod on which the annular piston (40) is mounted, and the other part (9*a*) sliding in the cylinder head (4).

5. An actuator according to claim 1, characterized by the fact that the cylinder body (2) is constituted by two coaxial portions (2*a*, 2*b*), of which an outer portion (2*a*) includes the cylinder head (4), means for fixing to a structure, couplings (17, 18, 19) for coupling to a fluid source, and a cylindrical outer wall (11) having inside tapping (12), and an inner other portion (2*b*) comprises the end wall (3) of the cylinder body (2) and the body of the cylinder chamber, and presents an outside thread (14) for co-operating with said inside tapping (12) so as to enable the predetermined extended position to be adjusted relative to the structure, internal ducts (20, 22, 23, 24) being provided in said two portions (2*a*, 2*b*) between the couplings (17, 18, 19) and the ends of the cylinder chamber.

* * * * *